United States Patent [19]

Herbst et al.

[11] Patent Number: 5,045,162

[45] Date of Patent: Sep. 3, 1991

[54] PROCESS FOR ELECTROCHEMICALLY REGENERATING CHROMOSULFURIC ACID

[75] Inventors: Hans Herbst, Meitingen; Jürgen Stenzel, Gersthofen; Siegfried Benninger, Burgkirchen, all of Fed. Rep. of Germany

[73] Assignee: Hoechst Aktiengesellschaft, Frankfurt, Fed. Rep. of Germany

[21] Appl. No.: 606,437

[22] Filed: Oct. 31, 1990

[30] Foreign Application Priority Data

Dec. 12, 1989 [DE] Fed. Rep. of Germany ..... 3940978

[51] Int. Cl.[5] ..... C02F 1/46

[52] U.S. Cl. ..... 204/130; 204/151

[58] Field of Search ..... 204/130, 151

[56] References Cited

U.S. PATENT DOCUMENTS 3,761,369 9/1973 Tirrell ..... 204/130

OTHER PUBLICATIONS

Bergner, D. et al, *Hoechst-Uhde-Membranzellen:* Oct. (1984) (Jahrestagung der Fachgruppe Angew. Elektrochem. of the German Society of Chemists).

*Primary Examiner*—T. M. Tufariello

[57] ABSTRACT

Chromosulfuric acid, which is used in many organic reactions as an oxidizing agent, can advantageously be regenerated electrochemically if an electrolysis cell is used which comprises two tub-like half shells with a current-permeable, hydraulically sealing partition situated inbetween. The hydrogen produced at the cathode can also be extracted and utilized in this way.

6 Claims, 4 Drawing Sheets

PROCESS FOR ELECTROCHEMICALLY REGENERATING CHROMOSULFURIC ACID

DESCRIPTION

Figure 1:
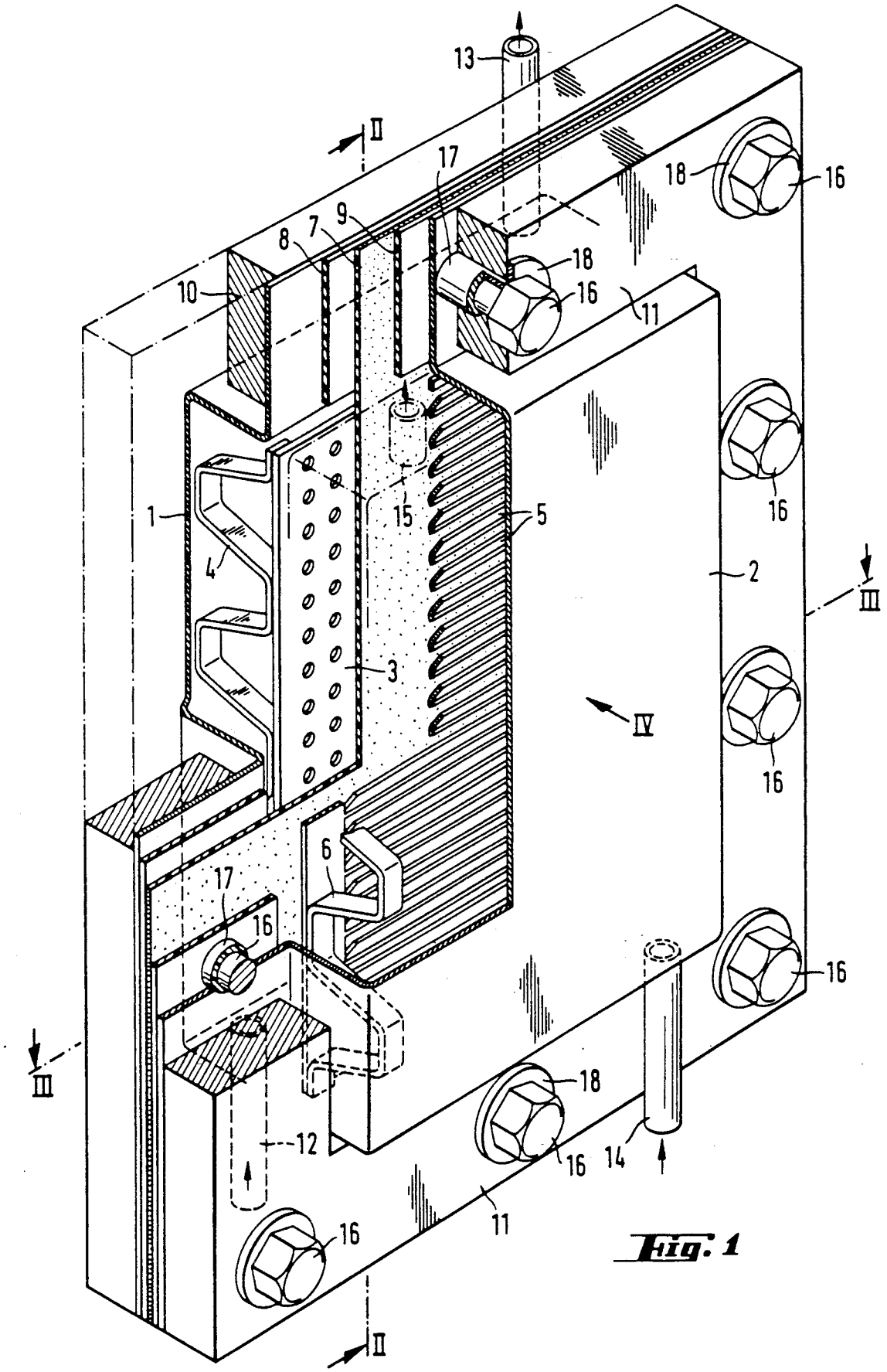

The invention relates to a process for electrochemically regenerating chromosulfuric acid in which a novel electrolysis cell is used.

In the electrochemical regeneration of chromosulfuric acid which has been used in oxidation processes, electrodes made of lead or lead alloys and electrolysis cells having lead walls, for example steel troughs lined with lead, are normally used.

The disadvantage of using lead or lead alloys is that the anodes lose their activity relatively fast and can be reutilized only to a limited extent and that a high hydrogen overvoltage (approximately 1.1 volt) appears at cathodes made of lead and lead alloys. It has also not yet been possible to carry out the electrolysis in sealed cells and to extract, in addition to the $Cr^{6+}$, also the hydrogen evolved at the cathode side. On the contrary, the hydrogen produced has to be sucked off the cells covered with foils and diluted with air in a ratio of about 50:1 so that work can be carried out safely below the explosion limit of about 4% $H_2$ in air. This procedure is uneconomical and open to objection for reasons of occupational hygiene and environmental protection.

A membrane cell for alkali-metal chloride electrolysis which comprises two half shells, one half shell being pressed from titanium sheet and the other from stainless steel or nickel sheet, is known (cf. Bergner and Hannesen, GDCH-Jahrestagung Angew. Elektrochemie, October 1984). The electrodes are each composed of a slatted metal sheet which is activated and welded into the half shell. At regular intervals, the electrodes are joined to the rear walls of the half shells by corrugated fasteners. The two half shells of a cell are separated from one another by a permeable membrane and seals.

The object was to find a process in which the chromosulfuric acid is regenerated in a sealed cell system and the hydrogen produced can be extracted.

It was found that the membrane cell developed for alkali-metal chloride electrolysis is also suitable in principle for the electrochemical regeneration of chromosulfuric acid.

The invention consequently relates to a process for electrochemically regenerating chromosulfuric acid by anodic oxidation of $Cr^{3+}$ ions to $Cr^{6+}$ ions, in which the anolyte contains 20 to 200 g/dm$^3$ total $CrO_3$ and 100 to 600 g/dm$^3$ $H_2SO_4$ and the catholyte contains 50 to 500 g/dm$^3$ $H_2SO_4$, which process comprises carrying out the regeneration in an electrolysis cell which comprises two tub-like metal half shells whose open sides face one another, a metal plate which is provided with holes or slots and which is joined to the anode tub by corrugated fasteners being present in the anode tub as anode, a metal sheet which is joined to the cathode tub by corrugated fasteners being present in the cathode tub as cathode, anode tub and cathode tub being separated from one another by a current-permeable, hydraulically sealing partition and seals and being held together by a clamping device, the temperature being 40° to 110° C. and the current density 100 to 2500 A/m$^2$.

The electrolysis cell to be used for the process according to the invention is explained with reference to FIGS. 1 to 4.

Figure 2:
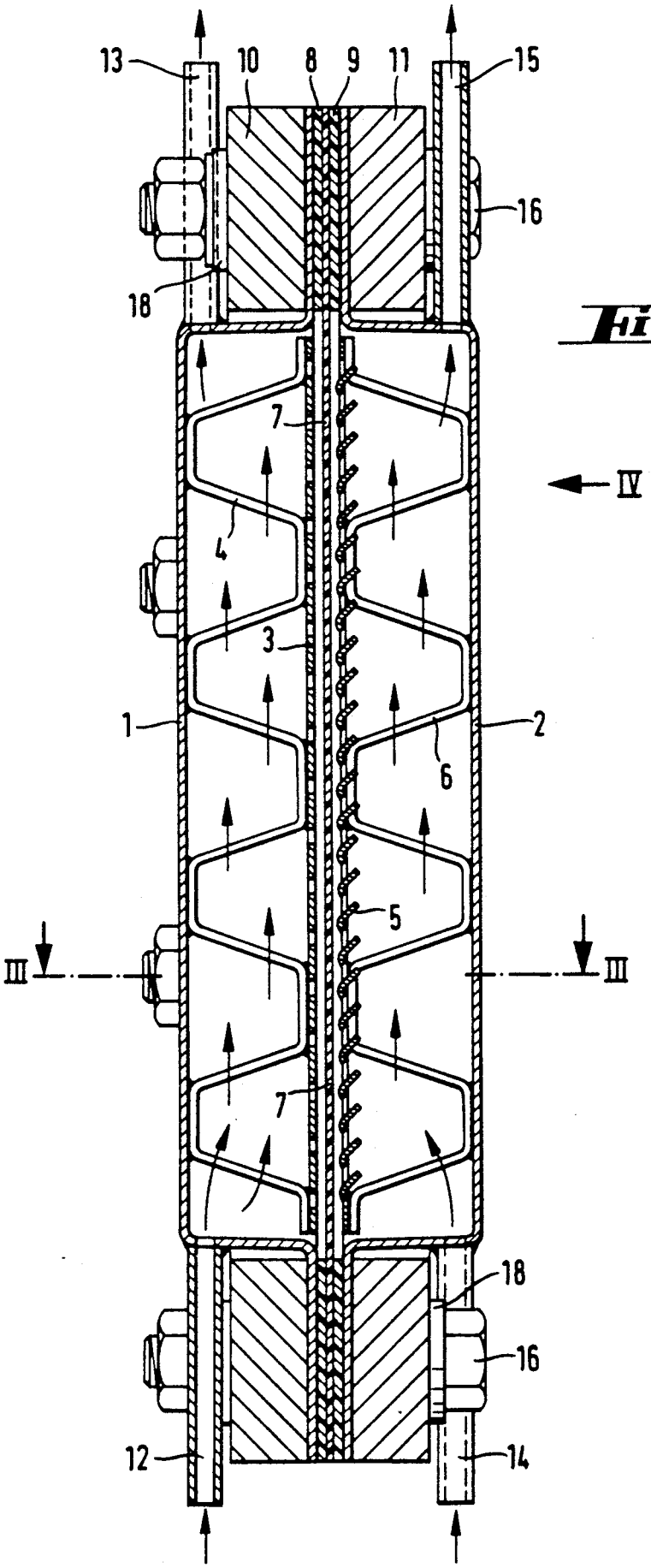
Figure 3:
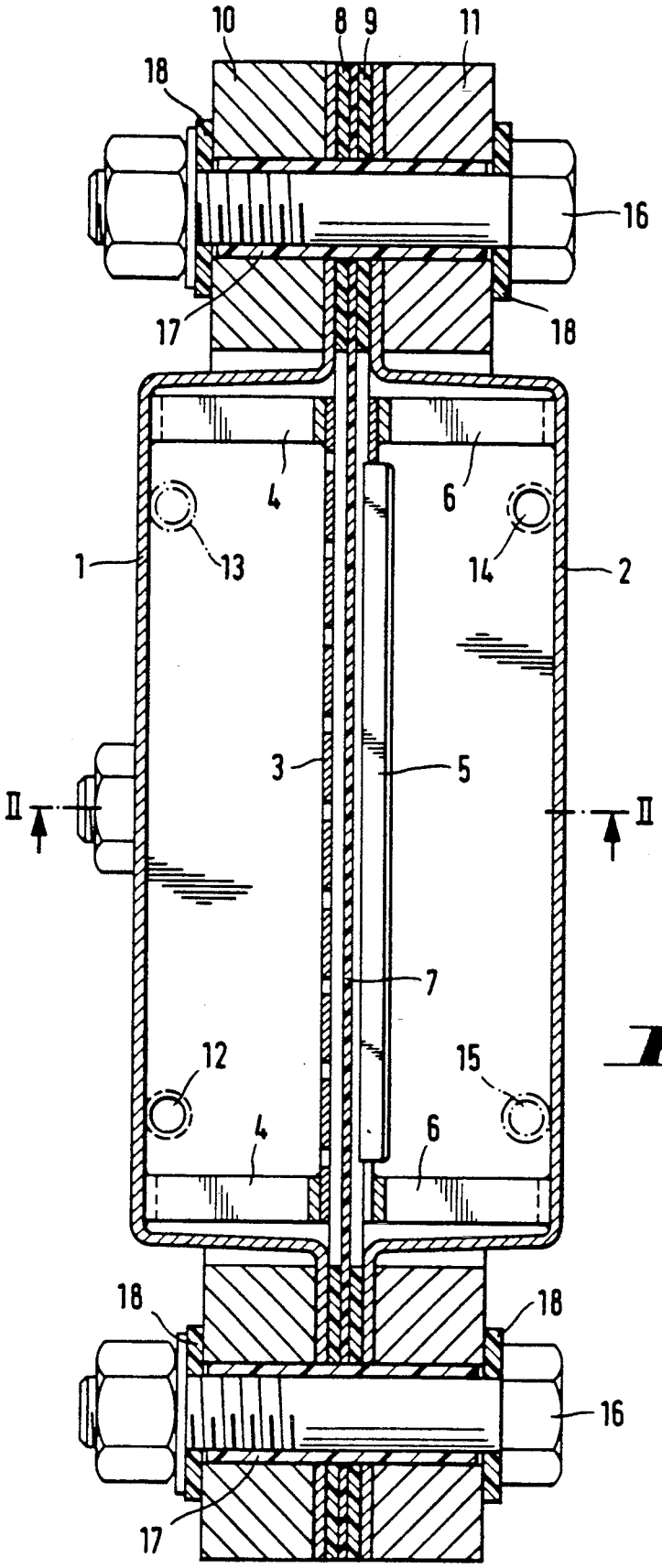
Figure 4:
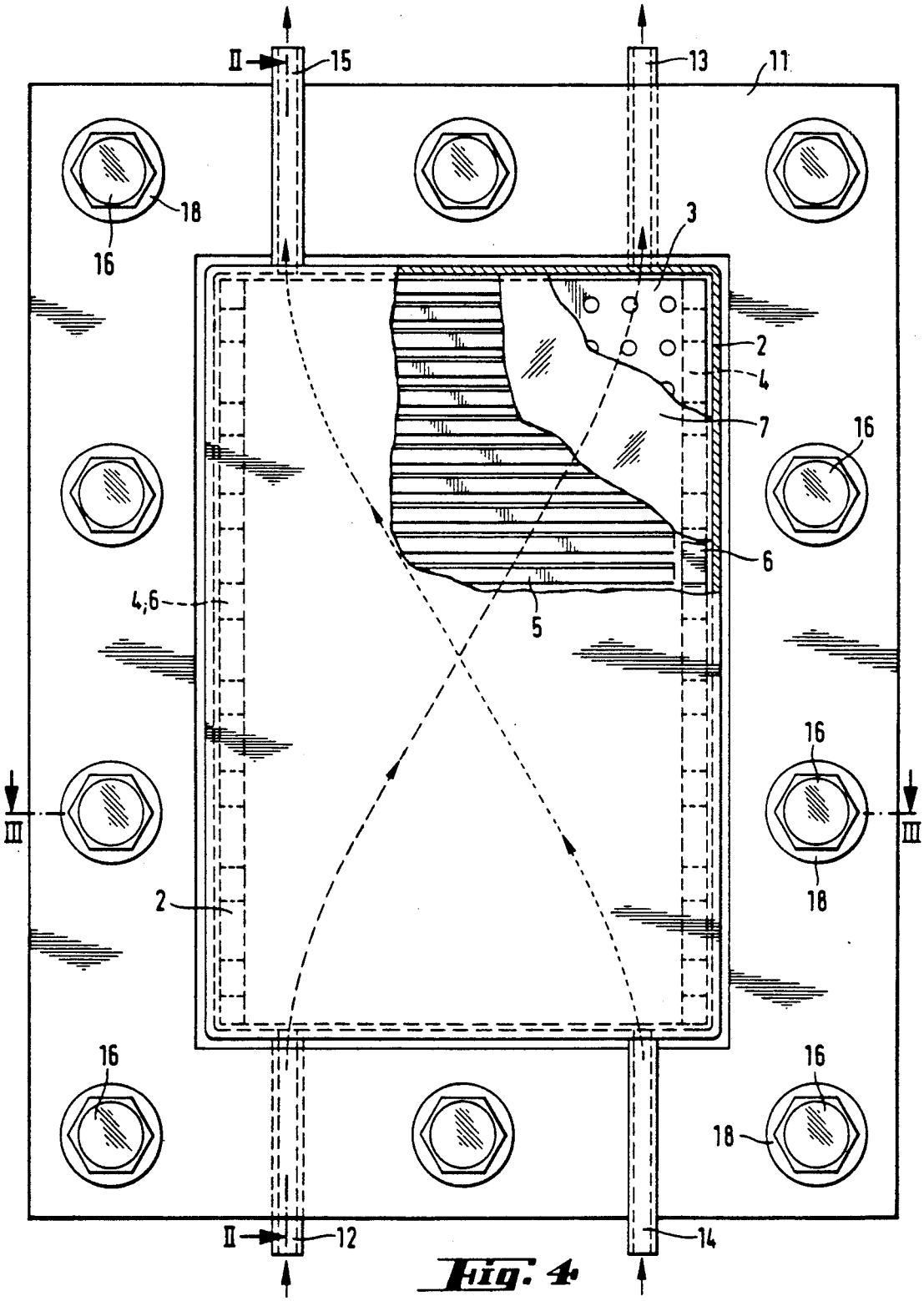

FIG. 1 shows a perspective overall view of an electrolysis cell,

FIG. 2 shows a section along the line II—II in FIGS. 1, 3 and 4, FIG. 3 shows a section along the line III—III in FIGS. 1, 2 and 4 and FIG. 4 shows a plan view in the direction of the arrow IV in FIGS. 1, 2 and 3.

According to FIG. 1, the cell comprises two tub-like metal half shells (1) and (2). The anode tub (1) contains a perforated or slotted plate (3) (perforated metal sheet, expanded metal or the like) which is joined to the anode tub (1) by means of corrugated fasteners (4). The plate (3) acts as anode. The cathode tub (2) contains a metal sheet (5) as cathode which is connected to the tub (2) by means of corrugated fasteners (6). The cathode is composed of a simple metal sheet, metal sheet strips, perforated metal sheet, expanded metal or slatted metal sheet, preferably of a slatted metal sheet.

Anode tub (1) and cathode tub (2) are separated from one another by a current-permeable, hydraulically sealing partition (7) and seals (8) and (9). They are held together to form a unit by two steel frames (10) and (11) which are screwed to each other in an insulated manner. The screws (16) are insulated by means of plastic bushes (17) and plastic washers (18). Located at the bottom of the anode tub (1) is an inlet pipe (12) for the anolyte and located on the cathode tub (2) is an inlet pipe (14) for the catholyte. Located at the top of the tubs (1) and (2) are the drainage pipes (13) and (15).

FIG. 2 shows, in addition, the position of the corrugated fasteners (4) and (6) and also the offset mounting of the inlet pipes (12) and (14).

From FIGS. 3 and 4 finally the encircling steel frame (11) can be seen.

The anode tub (1) and the corrugated fasteners (4) are composed of titanium, whereas the cathode tub (2) and the corrugated fasteners (6) are composed of nickel or a nickel alloy, for example ®Hastelloy.

It was found that the so-called "valve metals" titanium, tantalum, vanadium and zirconium used already in alkali-metal chloride electrolysis are also suitable as materials for the anode (3) under the corrosive conditions of chromic acid electrolysis. Under anodic current loading, these metals form a coherent oxide film on their surface which protects the basic material. If the surface of the anodes is not activated, the oxide layer formed prevents further current flow. For chromic acid electrolysis, only electron-conducting oxides which exhibit a high overvoltage with respect to oxygen, for example lead dioxide, manganese dioxide, tin dioxide, tantalum oxides or iridium oxides, are possible as suitable activation layers for these metals. One of the highest overvoltages for oxygen is exhibited by lead dioxide, which is preferred. Thus, the electrochemical reaction $$Cr^{3+} + 4H_2O - 3e^- \rightarrow CrO_4^{2-} + 8H^+$$

which proceeds anodically, yields current efficiencies of between 96% and 88% with current densities of 200 A/m$^2$ to 2500 A/m$^2$ at a titanium anode coated with $PbO_2$.

Suitable materials for the cathode (5) are nickel and nickel alloys, for example Hastelloy. If sulfuric acid is used as catholyte, protons are discharged and hydrogen evolved, which leaves the cathode space as a gas, at the cathode in accordance with the reaction equation $3H^+ + 3e \rightarrow 1.5H_2$ Nickel is only resistant to 10 to 35% sulfuric acid, however, if it is cathodically polarized. It is therefore necessary to prevent the nickel cathodes being exposed at zero current to the sulfuric acid.

At a current density of 100 A/m$^2$, the hydrogen overvoltage at nickel is relatively low at a level of 0.42 V, and in comparison therewith it is fairly high at a level of 1.09 V at lead under the same conditions. This has the consequence that the use of nickel as cathode results in a correspondingly lower cell voltage.

Cation-active ion exchanger membranes made of perfluorinated polymers containing sulfonyl groups have proved very satisfactory as current-permeable, hydraulically sealing partition (7) between anode space and cathode space. They exhibit an excellent durability and selectivity in the electrolytes used up to temperatures of 110° C. The use of such membranes makes it possible to collect the cathodically evolved hydrogen separately and supply it to a further utilization.

The electrolysis cell to be used and assembled according to the invention can be operated after filling the cathode space with catholyte and the anode space with anolyte and after pressing current leads from a rectifier onto the anode tub rear wall and cathode tub rear wall. Catholyte and anolyte are each continuously fed in from stock containers by means of pumps at the lower end of the electrode space. The electrolyte leaves the cell at the top end. The anolyte with the desired composition is supplied for further use, while the catholyte is continuously circulated via a buffer container and concentrated again from time to time.

The oxygen evolution (due to water decomposition) which proceeds to a small extent at the anode and is undesirable per se ensures an adequate mixing of the anolyte and promotes the diffusion of $Cr^{3+}$ at the anode surface. This effect can be intensified by additionally injecting inert gas into the anode space.

Preferably, this electrolysis cell is not operated separately. On the contrary, in a cell assembly a plurality of cells is pressed together rear wall to rear wall by means of a clamping device. Consequently, the current fed in with copper rails at the beginning of the cell array is able to flow through all the cells and is drained at the end of the array by copper rails. Special contact strips ensure a good current transfer between the cells. If the cells are operated in this manner, the cell is a bipolar one. All the individual elements are connected in series.

The concentration in the anolyte is 20 to 200, preferably 100 to 200, in particular 130 to 170 g/dm$^3$ total $CrO_3$ and 100 to 600, preferably 300 to 600, in particular 450 to 550 g/cm$^3$ $H_2SO_4$. The catholyte contains 50 to 500, preferably 300 to 350 g/dm$^3$ $H_2SO_4$.

The electrolysis is carried out at a temperature of 40° to 110°, preferably 80° to 110° C., and at a current density of 100 to 2500, preferably 500 to 2500 A/m$^2$.

The process according to the invention will now be explained by way of the following examples.

EXAMPLE 1

The electrolysis was carried out in a round laboratory membrane cell which was composed of 2 glass shells and was flanged together so as to seal by means of two PTFE O-rings. The two glass shells formed the cathode space and anode space. They were separated by a polymer membrane made of a perfluorinated polymer which was clamped between the two O-rings.

The two circular electrodes were eccentrically mounted and direct current was supplied via these mountings. It was possible to vary anode and cathode in their distance from one another and from the membrane by means of spacing strips. Anolyte and catholyte were heated with heating rods to 90° C. in the two cell halves and were kept constant at this temperature during the electrolysis.

| | |
|---|---|
| Anode space volume: | 95 cm$^3$ |
| Cathode space volume: | 90 cm$^3$ |
| Active anode area: | 36 cm$^2$ |
| Cathode area: | 36 cm$^2$ |

The cathode was composed of non-activated nickel expanded metal, the anode of titanium expanded metal which was coated on all sides with electrodeposited $PbO_2$. The cathode-anode spacing was 8 mm.

| | |
|---|---|
| Anolyte: | 550-560 g/l $H_2SO_4$ |
| | 200 g/l total $CrO_3$ = 104 g/l Cr |
| Catholyte: | 440-445 g/l $H_2SO_4$ (35%) |

At the same time, the catholyte was circulated by pumping through the cathode space at an throughput of 9 cm$^3$/h which was constant for all current densities. The electroylsis are data obtained shown in Table 1.

TABLE 1

| | | | |
|---|---|---|---|
| Current density (A/m$^2$) | 500 | 1,500 | 2,500 |
| Throughput (cm$^3$/h) | 21 | 60 | 94 |
| Degree of oxidation (%) | 50 | 52 | 52 |
| Cell voltage (V) | 2.25 | 2.56 | 2.90 |
| Current efficiency based on $Cr^{6+}$ formation (%) | 96.0 | 91.5 | 88.5 |
| Energy requirement (kWh/kg $CrO_3$) | 1.95 | 2.40 | 2.90 |
| Total running time: | 249 days | | |
| Total current consumption: | 26,000 Ah 7,429 kAh/m$^2$ | | |
| $CrO_3$ produced: | 28.97 kg = 8,277 kg/m$^2$ | | |

EXAMPLE 2

A titanium expanded metal anode activated with tantalum oxide/iridium oxide mixture was tested for its suitability in a second glass cell which corresponded completely to the cell described above in its construction.

| | |
|---|---|
| Cathode: | nickel expanded metal |
| Anode: | titanium expanded metal activated with $Ta_2O_5/IrO_2$ |
| Membrane: | perfluorinated polymer |
| Temperature: | 90° C. |
| Anode-cathode spacing: | 8 mm |
| Electrolyte composition as in Example 1 | |

A notable feature was the low cell voltage of 1.92 V for a current loading of 500 A/m$^2$ compared with that in Example 1. However, the current efficiency in relation to $CrO_3$ formation of on average only 61% with a comparatively low degree of oxidation of 44% was lower. This resulted in a relatively high energy requirement of 2.65 kWh/kg $CrO_3$ at 500 A/m$^2$. A heavier gas evolution (analyzed as $O_2$), which is attributable to the lower oxygen overvoltage of this activation coating compared with $PbO_2$, was to be observed on the anode side. With increasing current loading, the current efficiency decreased still further and reached only about 49%, for example, at 1,500 $A/m^2$.

EXAMPLE 3

Chromosulfuric acid was electrolytically regenerated in a membrane cell as described in FIGS. 1 to 4.

| | |
|---|---|
| Anode space volume: | 1,150 $cm^3$ |
| Cathode space volume: | 870 $cm^3$ |
| Anode area: | 285 $cm^2$ |
| Cathode area: | 285 $cm^2$ |
| Anode material: | titanium expanded metal activated with $PbO_2$ |
| Cathode material: | slat-type nickel lamella sheet |
| Cathode-anode spacing: | 9 mm |
| Anolyte: | 470 g/l $H_2SO_4$<br>160 g/l total $CrO_3$ = 83.2 g/l Cr |
| Catholyte: | 440-445 g/l $H_2SO_4$ |
| Temperature: | 85-95° C. |
| Current density: | 500 $A/m^2$ |
| Throughput: | 140 $cm^3/h$ |
| Degree of oxidation: | 65% |
| Cell voltage: | 2.65 V |
| Current efficiency: | 91% based on $Cr^6$ formation |
| Energy requirement: | 2.25 kWh/kg $CrO_3$ |

We claim:

1. A process for electrochemically regenerating chromosulfuric acid by anodic oxidation of $Cr^{3+}$ ions to $Cr^{6+}$ ions, in which the anolyte contains 20 to 200 $g/dm^3$ total $CrO_3$ and 100 to 600 $g/dm^3$ $H_2SO_4$ and the catholyte contains 50 to 500 $g/dm^3$ $H_2SO_4$, which process comprises carrying out the regeneration in an electrolysis cell which comprises two tub-like metal half shells whose open sides face one another, a metal plate which is provided with holes or slots and which is joined to the anode tub by corrugated fasteners being present in the anode tub as anode, a metal sheet which is joined to the cathode tub by corrugated fasteners being present in the cathode tub as cathode, anode tub and cathode tub being separated from one another by a current-permeable, hydraulically sealing partition and seals and being held together by a clamping device, the temperature being 40° to 110° C. and the current density 100 to 2500 $A/m^2$.

2. The process as claimed in claim 1, wherein an anode is used which is a titanium, zirconium, vanadium or tantalum expanded metal.

3. The process as claimed in claim 2, wherein the anode is activated by a coating which has a high overvoltage with respect to oxygen.

4. The process as claimed in claim 1, wherein a cathode is used which is a slatted metal sheet made of nickel or a nickel alloy.

5. The process as claimed in claim 1, wherein an ion exchanger membrane which is composed of a perfluorinated polymer is used as current-permeable, hydraulically sealing partition.

6. The process as claimed in claim 1, wherein the electrolysis is carried out in a bipolar cell.

* * * * *